United States Patent [19]

Zwick et al.

[11] 4,278,634

[45] Jul. 14, 1981

[54] BICONSTITUENT ACRYLIC FIBERS BY MELT SPINNING

[75] Inventors: Maurice M. Zwick, Stamford, Conn.; William J. van Loo, Sarasota, Fla.

[73] Assignee: American Cyanamid Company, Stamford, Conn.

[21] Appl. No.: 179,380

[22] Filed: Aug. 18, 1980

[51] Int. Cl.[3] ..... D01D 5/22

[52] U.S. Cl. ..... 264/168; 264/171; 264/210.3; 264/210.6; 428/373

[58] Field of Search ..... 428/373; 264/168, 171, 264/206, 210.3, 210.6

[56] References Cited

U.S. PATENT DOCUMENTS

| | | | |
|---|---|---|---|
| 3,801,429 | 4/1974 | Schrenk et al. | 264/171 |
| 4,062,857 | 12/1977 | Kobayashi et al. | 264/182 |
| 4,161,500 | 7/1979 | Schleinitz et al. | 428/373 |
| 4,219,523 | 8/1980 | Porosoff | 264/210.3 |

*Primary Examiner*—Jay H. Woo

*Attorney, Agent, or Firm*—Frank M. Van Riet

[57] ABSTRACT

A mixture of (1) a single phase melt of water and a first acrylonitrile polymer containing at least 85% acrylonitrile and (2) a pure melt of a second acrylonitrile polymer containing from about 60–72% acrylonitrile is extruded through the orifices of a spinneret directly into a steam-pressurized solidification zone to provide a biconstituent fiber which is stretched while within the solidification zone.

10 Claims, No Drawings

BICONSTITUENT ACRYLIC FIBERS BY MELT SPINNING

This invention relates to a melt-spinning process for producing bicomponent acrylonitrile polymer fiber. More particularly, this invention relates to such a process wherein two fiber-forming acrylonitrile polymers of different acrylonitrile contents are prepared in separate melt forms, the resulting melts are extruded together through the same spinneret orifices directly into a steam-pressurized solidification zone maintained under conditions which control the rate of release of water from the nascent extrudate and the nascent extrudate is stretched to provide molecular orientation while it remains within the solidification zone.

As employed herein and in the appended claims, a "bicomponent fiber" is one formed by physically joining together two generically similar but chemically or physically different polymers. In the present invention, the two polymers are acrylonitrile polymers and thus are generically similar but the polymers differ in their content of acrylonitrile and have different physical properties as a result.

In the past bicomponent acrylonitrile polymer fiber was prepared by wet- or dry-spinning procedures. This was because the known useful fiber-forming acrylonitrile polymers could not be melted without severe polymer deterioration and, as a result, melt-spinning could not be employed. Recent developments in the field of acrylonitrile polymer fiber have led to melt-spinning procedures in which single-phase melts of acrylonitrile polymer and water at a temperature above the boiling point of water at atmospheric pressure and at a pressure which maintains water in liquid state are extruded through a spinneret to form fiber, see for example, U.S. Pat. Nos. 3,984,601 (Blickenstaff), 3,869,204 (Goodman et al.) and 4,163,770 (Porosoff). However, none of these recent developments have dealt with the subject of bicomponent fibers.

Another recent development in the field of acrylonitrile polymers was the finding that certain of these polymers, i.e., those having acrylonitrile contents in the range of about 60–70% by weight could be prepared as pure polymer melts without polymer deterioration. However, fiber properties of these polymers have not been acceptable.

Bicomponent fibers are highly desirable for many uses because such fibers can be made to be self-crimping and of desirable bulk. These properties and others result from the different physical properties of the two polymer components which show good adhesion, one to the other. While bicomponent acrylonitrile polymer fiber of highly desirable properties can be produced by wet- or dry-spinning procedures, the requirement for use of a polymer solvent is undesirable due to the problem of solvent removal and recovery. The solvents are of such a nature as to contribute to process costs and to cause environmental pollution problems if not recovered from the process. Removal of polymer solvent from the resulting fiber is not always complete at the completion of the fiber-making process and residual solvent may be exuded in subsequent hot-wet fiber treatments, such as dyeing, thus giving rise to environmental pollution problems subsequent to the fiber-making process. Accordingly, there exists the need for processes for preparing bicomponent acrylonitrile polymer fiber which avoid the problems associated with wet- and dry-spinning procedures and provide such fiber of desirable textile properties.

In accordance with the present invention there is provided a process for producing bicomponent acrylonitrile polymer fiber composed of two polymers of different acrylonitrile contents which comprises preparing a single-phase melt of a first fiber-forming acrylonitrile polymer and water, said first acrylonitrile polymer containing at least about 85 weight percent of acrylonitrile and said melt being at a temperature above the boiling point of water at atmospheric pressure and at a pressure which maintains water in a liquid state; preparing a pure melt of a second fiber-forming acrylonitrile polymer, said second acrylonitrile polymer containing from about 60–72 weight percent acrylonitrile, said pure melt being at the temperature and pressure of said single-phase polymer-water melt, and the difference in acrylonitrile contents of said first and said second acrylonitrile polymers being less than about 30 weight percent; extruding said single-phase polymer-water melt and said pure melt together through the orifices of a spinneret assembly directly into a steam-pressurized solidification zone maintained under conditions which control the release of water from the nascent extrudate; and stretching the nascent extrudate while it remains within said solidification zone to provide molecular orientation of said polymers.

In preferred embodiments, the resulting fiber is dried under conditions indicated by dry-bulb temperatures in the range of about 110°–150° C. and wet-bulb temperatures in the range of about 60°–90° C. and relaxed in steam or boiling water. The fiber produced is a self-crimping fiber due to the different properties of the two acrylonitrile polymers making up the bicomponent fiber. Drying and relaxing will cause crimp to develop in the fiber. Since it is generally desirable to supply the fiber in uncrimped form, the dried and relaxed fiber is heated and restretched under just sufficient tension to remove temporarily the crimp that has developed.

The bicomponent fiber produced in accordance with the present invention exhibits good adhesion between the two polymer components in spite of the fact that the polymers were in different melt states when merged. The difference in physical properties of the two polymers can be varied by changing polymer compositions within the ranges indicated and the degree of crimping can be varied accordingly. The textile properties of the melt-spun bicomponent acrylonitrile polymer fiber are generally better than are those of comparable fiber prepared by wet- or dry-spinning procedures. Because no polymer solvent is employed in processing the bicomponent acrylonitrile polymer fiber, no solvent recovery or environmental pollution problems are encountered.

In carrying out processing in accordance with the present invention, two different melts of two distinct fiberforming acrylonitrile polymers are employed. An acrylonitrile polymer having a high content of acrylonitrile is prepared in the form of a polymer-water single-phase fusion melt and an acrylonitrile polymer of lower acrylonitrile content is prepared as a pure polymer melt, i.e., no water or other melt assistant is employed.

The acrylonitrile polymer of high acrylonitrile content will contain at least 85 weight percent acrylonitrile and any balance of one or more monomers copolymerizable therewith. Fiber-forming acrylonitrile polymers of this acrylonitrile content are well known in the art as are the preparative procedures. Suitable polymer-water melts of such polymers are readily prepared as homogeneous single-phase melts by heating appropriate quantities of polymer and water to a temperature above the boiling point of water at atmospheric pressure and at a pressure sufficient to maintain water in liquid state. Depending upon polymer composition and other factors, the quantity of water will generally be in the range of about 10 to 30 weight percent based on the total weight of polymer and water. At least autogenous pressure is employed and melts result at temperatures safely below the deterioration temperature of the polymer.

The acrylonitrile polymer of low acrylonitrile content will contain from about 60 to about 72 weight percent acrylonitrile and any balance of one or more monomers co-polymerizable with acrylonitrile. Suitable comonomers which provide the pure melt polymer include, for example, ethyl or methyl acrylate, butyl acrylate, isopropyl methacrylate, vinyl acetate, isobutylene, styrene, dichlorostyrene, and butadiene. These polymers are also known in the prior art as is their method of preparation. This polymer type when heated as a pure polymer forms a melt without significant deterioration of the polymer and it can provide a fluid melt at the temperatures and pressure used to form the polymer-water melt.

As previously indicated, the difference in acrylonitrile content of the two acrylonitrile polymers should not exceed about 30 weight percent since differences above this value lead to poor adhesion between the two polymer types. As can be appreciated from the relative ranges of acrylonitrile contents specified for the two polymers, the minimum difference in acrylonitrile contents will be about 13%.

The two distinct polymer melts are prepared separately in accordance with prior art procedures. Typically such melts can be prepared by use of screw extruders and the like.

After the two polymer melts are obtained, they are extruded together through the same orifices of a spinneret assembly. During such extrusion, the two polymer melts unite at their interfaces as they pass through the spinneret orifices. In conducting such extrusion the quantities of the individual polymer melts that are united may vary as may the manner in which the uniting is accomplished. In forming the conventional side-by-side bicomponent fiber, it is possible to provide equal proportions of the two polymers making up the fiber components or to provide varying amounts by adjusting the pumping rates of the two polymer melts being extruded. It is generally preferable to form such side-by-side bicomponent fiber in which the component of the higher acrylonitrile content forms 50 weight percent or more of the total polymer content of the fiber since such polymer generally provides better textile properties.

An alternative embodiment is to pass the polymer melts through a static mixer, such as a plate mixer, at a low degree of mixing to provide a random bicomponent fiber in which the polymer of higher acrylonitrile content preferably forms from about 60 to about 90 weight percent of the total polymer content of the fiber and the polymer of lower acrylonitrile content forms the balance, preferably the polymer of lower acrylonitrile content forms about 18 to 32 weight percent of the total polymer content.

The extrusion step is carried out in a manner such that the extrudate from the spinneret assembly emerges directly into a steam-pressurized solidification zone maintained under conditions which control the rate of release of water from the nascent extrudate and provide a stretchable extrudate in accordance with prior art teachings. Generally these conditions arise by use of saturated steam at a pressure such as to provide a temperature that is from about 20° C. to about 60° C. below the temperature at which extrusion is conducted. Under the proper conditions of steam pressure in the solidification zone, the nascent extrudate will remain in stretchable state while therein.

The nascent extrudate is subjected to stretching while it remains within the solidification zone to provide improved physical properties believed to result from polymer orientation. The extent to which stretching is accomplished will vary widely depending upon numerous factors, such as the extent to which fiber property improvements are desired and the like. Typically, stretching is accomplished in one or more stages to provide a total stretch ratio of about 25 or more since at such stretch ratios admirable textile properties are achieved.

After stretching, the fiber exits from the solidification zone and such additional processing as may be desired can be conducted. It is generally preferable to dry the stretched fiber under conditions of humidity encompassed by dry-bulb temperatures in the range of about 110° C. to about 150° C. and wet-bulb temperatures in the range of about 60° C. to about 90° C. Drying under such conditions tends to minimize void formation within the fiber structure and improves fiber transparency. It is also generally preferred to relax the stretched extrudate after drying to achieve a shrinkage of 20% or more to provide a desirable balance of textile properties in the resulting fiber. Such relaxing may be in steam or boiling water depending upon the nature of the stretchability.

The invention is more fully illustrated in the examples which follow wherein all parts and percentages are by weight unless otherwise specified.

EXAMPLE 1

The two acrylonitrile polymers used in preparing a bicomponent fiber are as follows:

Polymer A 85 parts acrylonitrile
12 parts methyl methacrylate—grafted onto
3 parts polyvinyl alcohol weight average molecular weight≅54,000

Polymer B 66.6 parts acrylonitrile
23.4 parts methyl acrylate—grafted onto
10.0 parts butadiene rubber weight average molecular weight≅87,500

Polymer A is prepared as a polymer-water melt using 82 parts polymer and 18 parts water at a temperature of 175° C. and autogenous pressure using a screw extruder.

Polymer B is prepared as a pure polymer melt at 175° C. using a second screw extruder.

The two polymer melts are then fed to a spinneret assembly containing a distributor means for extruding the polymers in side-by-side arrangement through the same orifices of the spinneret plate having 80 round orifices each of 160 micron diameter, the relative polymer melt feed rates being such as to provide fiber containing 50% of each polymer component. The bicomponent extrudate emereges from the spinneret orifices directly into a steam-pressurized solidification zone maintained with saturated steam at a temperature of 120° C. The nascent extrudate is drawn down by a factor of 8 and while it remains within the solidification zone is stretched in a second stage of stretching at a stretch ratio of 10 to provide a total stretch ratio of 80 relative to the linear velocity of the polymer melts through the spinneret. After stretching, the extrudate emerges from the solidification zone through a pressure seal and is collected on a winder. The as-spun fiber denier is 2.54 denier per filament. The fiber is dried in tensionless state at a dry bulb temperature of 75° C. The dried fiber is then relaxed in steam at a temperature of 118° C. during which fiber shrinkage of 32% results. The final fiber has a denier of 3.7 per filament. During the processing as described, the fiber develops a high level of stable crimps, about 18 crimps per inch.

EXAMPLE 2

Polymer A is the same as that used in Example 1. Polymer B is a terpolymer of the following composition 70 parts acrylonitrile 26 parts methyl methacrylate 4 parts styrene weight average molecular weight≅80,000

Melts are prepared as in Example 1. The melts are processed through a plate mixer using minimum shear and extruded as a random bicomponent fiber through 80 round spinneret orifices each of 160 micron diameter. The two polymer melts are proportioned such that the extrudate contains 70% of polymer A and 30% of polymer B. Processing subsequent to extrusion is as in Example 1. The final fiber possesses a spontaneous crimp of a frequency of about 6–12 crimps per inch. The fiber is highly transparent due to the close matching of the refractive indices of the two polymers.

EXAMPLE 3

The procedure of Example 2 is repeated in every material detail except in place of the polymer used as polymer B therein there is used a copolymer of the following composition:

64 parts acrylonitrile 36 parts butyl acrylate weight average molecular weight≅75,000

The melts are proportioned during extrusion through the spinneret assembly in the ratio of 75 parts polymer A to 25 parts polymer B. A spontaneous crimp develops in the resulting bicomponent fiber after complete processing.

EXAMPLE 4

The procedure of Example 2 is again followed in every material detail except that in place of polymer B, there is employed a polymer of the composition:

70 parts acrylonitrile 20 parts methyl methacrylate 10 parts hydroxyethyl acrylate weight average molecular weight≅75,000

The metls are proportioned in the ratio 72 parts polymer A and 28 parts polymer B. The resulting fiber has a spontaneous crimp and a higher moisture regain than conventional acrylonitrile polymer fibers.

EXAMPLE 5

The procedure of Example 1 is repeated in every material detail except that subsequent to the processing described the fiber is passed through a heated oven at about 110° C. and wound under tension equivalent to a stretch ratio of about 1.05. This treatment removes temporarily the spontaneous crimp which had developed. The wound fiber, when subjected to dyeing, redevelops the same crimp level spontaneously developed during initial processing.

We claim:

1. A process for producing bicomponent acrylonitrile polymer fiber composed of two polymers of different acrylonitrile contents which comprises preparing a single-phase melt of a first fiber-forming acrylonitrile polymer and water, said first acrylonitrile polymer containing at least about 85 weight percent acrylonitrile and said melt being at a temperature above the boiling point of water at atmospheric pressure and at a pressure which maintains water in liquid state; preparing a pure melt of a second fiber-forming acrylonitrile polymer, said second acrylonitrile polymer containing from about 60–72 weight percent acrylonitrile, said pure melt being at the temperature and pressure of said single-phase polymer-water melt, and the difference in acrylonitrile contents of said first and said second acrylonitrile polymers being less than about 30 weight percent; extruding said single-phase polymer-water melt and said pure melt together through the orifices of a spinneret assembly directly into a steam pressurized solidification zone maintained under conditions which control the release of water from the nascent extrudate; and stretching the nascent extrudate while it remains within said solidification zone to provide molecular orientation of said polymers.

2. The process of claim 1 including the additional step of drying the nascent extrudate under dry-bulb temperatures in the range of 110°–150° C. and wet-bulb temperatures in the range of 60°–90° C.

3. The process of claim 2 including the additional step of relaxing the dried extrudate in steam or boiling water.

4. The process of claim 1 wherein the first acrylonitrile polymer is a graft of 85 parts acrylonitrile and 12 parts methyl methacrylate on 3 parts polyvinyl alcohol.

5. The process of claim 1 wherein the second acrylonitrile polymer is a terpolymer of 70 parts acrylonitrile, 26 parts methyl methacrylate and 4 parts styrene.

6. The process of claim 4 wherein the second acrylonitrile polymer is a terpolymer of 70 parts acrylonitrile, 26 parts methyl methacrylate and 4 parts styrene.

7. The process of claim 1 wherein the second acrylonitrile polymer is a copolymer of 64 parts acrylonitrile and 36 parts butyl acrylate.

8. The process of claim 1 wherein the second acrylonitrile polymer is a graft of 66.6 parts acrylonitrile and 23.7 parts methyl acrylate on 10 parts of butadiene rubber.

9. The process of claim 1 wherein the second acrylonitrile polymer is a terpolymer of 70 parts acrylonitrile, 20 parts methyl methacrylate and 10 parts hydroxyethyl acrylate.

10. The process of claim 3 including the additional step of heating and winding the relaxed fiber under tension to remove temporarily the spontaneous crimp.

* * * * *